US006173633B1

(12) United States Patent
McLaughlin

(10) Patent No.: US 6,173,633 B1
(45) Date of Patent: Jan. 16, 2001

(54) VARIABLE LENGTH ROTARY CUTTING SYSTEM

(76) Inventor: James McLaughlin, P.O. Box 17645, Huntsville, AL (US) 35810

( * ) Notice: Under 35 U.S.C. 154(b), the term of this patent shall be extended for 0 days.

(21) Appl. No.: 09/288,882

(22) Filed: Apr. 9, 1999

(51) Int. Cl.[7] ..... B26D 1/62; B26D 5/20

(52) U.S. Cl. ..... 83/37; 83/346; 83/354; 83/493; 83/593; 83/603; 83/324

(58) Field of Search ..... 83/37, 38, 354, 83/493, 494, 593, 603, 674, 678, 346, 659, 324

(56) References Cited

U.S. PATENT DOCUMENTS

| | | | | |
|---|---|---|---|---|
| 2,142,685 | | 1/1939 | Sigoda | 164/175 |
| 2,642,938 | | 6/1953 | Hallden | 164/68 |
| 2,829,713 | | 4/1958 | Nilsson | 164/49 |
| 3,084,581 | | 4/1963 | Weber et al. | 83/300 |
| 3,176,565 | * | 4/1965 | Shields | 83/593 |
| 3,608,411 | * | 9/1971 | Schmidt | 83/38 |
| 3,793,927 | * | 2/1974 | Emond | 83/324 |
| 3,875,838 | | 4/1975 | Reppert | 83/337 |
| 4,058,041 | | 11/1977 | Ito | 83/305 |
| 4,255,998 | | 3/1981 | Rudszinat | 83/298 |
| 5,265,506 | * | 11/1993 | Aihara et al. | 83/346 |
| 5,797,305 | * | 8/1998 | Harrod et al. | 83/346 |

* cited by examiner

*Primary Examiner*—M. Rachuba
*Assistant Examiner*—Sean Pryor
(74) *Attorney, Agent, or Firm*—Womble Carlyle Sandridge & Rice

(57) ABSTRACT

A variable length rotary cutting system for cutting sheet material in various desired cut lengths, including a knife roll and an anvil roll between which the sheet material is passed for cutting. A drive system drives the knife roll at varying speeds during a cycle of rotation and includes a drive gear and an offset gear mounted in an off-center mounting so as to be rotated at varying speeds by the drive gear. The rotation of the offset gear is transmitted to the knife roll so as to cause the knife roll to rotate at varying speeds about a cycle of rotation to enable the knife roll to cut varying lengths of the sheet material.

11 Claims, 3 Drawing Sheets

VARIABLE LENGTH ROTARY CUTTING SYSTEM

TECHNICAL FIELD

This invention relates to sheet material cutting devices, and in particular, to a variable length rotary cutting system having a knife roll driven by a drive system including different pitch diameter gears, one of which is mounted in an off-center arrangement, so as to vary the speed of the knife roll for cutting a desired length of sheet material.

BACKGROUND OF THE INVENTION

For cutting, die cutting and perforating sheet materials such as non-wovens, paper, foils, films and woven materials, such sheet materials generally are cut manually or, in more automated processes, using sheet length cutting devices such as a rotary cutter. In conventional manual cutting systems, the sheet material generally is run to a desired length and is stopped by either stopping the machine or through the use of an accumulator. After the machine has been stopped, or a sufficient amount of material received in the accumulator, a knife or cutter, such as a guillotine or rotary shears, is engaged to cut the desired length of sheet material. Such a method is, however, somewhat time consuming as the material must be continually stopped and started prior to and after a cut is made. Further, if the converting machine from which the material is fed is operating at speeds that are too high, i.e., is passing the sheet material at too fast a rate for the use of an accumulator, or if the machine cannot be readily and easily stopped and started, a rough, jagged cut often results making the use of such stationary or manual cutters impractical.

Rotary cutters generally are designed to make cuts in a moving web or sheet material such as a non-wovens, paper, film, foil, or a woven material that is moving at high speeds without stopping to form the desired lengths of sheet material. Such rotary cutters generally include a rotating anvil roll made from a hardened steel or similar material, and a rotating knife roll having a knife blade or blades mounted thereon. Generally, the circumference of the knife roll dictates the length of sheet material to be cut. In order to achieve a clean cut in the web or sheet material, the rotary knife generally must be moving at or close to the speed of the material being cut and must be matched with the speed of rotation of the anvil roll. When the knife engages the material at the same speed as the material is moving, a clean cut is made just as if the material were stopped and the cut made by scissors or stationary knife.

Rotary cutters are, however, generally limited to a set cut length as the circumference of the knife cylinder generally must match the length of the cut desired. If the sheeting line is not dedicated to cutting only one cut length and instead it is necessary or desired to cut different lengths of sheet materials on the same sheeting line, it becomes necessary either to change the knife rolls to substitute different knife rolls having circumferences matched to the different cut lengths desired, or to vary the speed of the rotation of the knife rolls to shorten or lengthen the cut made by the knife roll. The primary problem with changing out the knife rolls is the expense and labor required to make such a change in the knife roll. The knife rolls for such rotary cutters are extremely expensive, typically costing tens of thousands of dollars, and given the size and weight of these rolls, their change out is somewhat labor intensive. In addition, since the cut length permitted by the knife rolls is limited to the circumference of the knife rolls, each knife roll still is able to accommodate only one cut length. Therefore, given the high costs and labor required for changing such rotary cutters, maintaining an inventory of several different sized knife rolls for cutting varying lengths of sheet material generally is impractical, especially given the number of variations in cut lengths that could be required.

Attempts further have been made to try to vary the length of the cut made by the knife roll of a rotary cutter by varying the speed of the knife roll with respect to the speed of movement of the sheet material. However, such variations in the speed of rotation of the knife roller typically result in ragged or rough cuts due to bunching or wrinkling of the material behind the knife where the knife roll is moved at a slower rate than the rate of movement of the material, or as the knife is moved at a faster rate than the rate of movement of the material, the material tends to be pulled and thus torn or ripped. This is especially a problem for cuts greater than the circumference of the knife roll. Clutch drive systems have been developed to try to solve this problem of controlling the rotational speed of the knife roll for varying the length of cut of the sheet material. In such system, clutches are engaged and disengaged to speed up and slow down the knife roll. The problem with such clutches is they provide inaccurate control of the rotation of the knife roll as clutches tends to slip and do not always tends to engage at the same rate. Thus, conventional clutch systems generally have not provided desired reliability and control to ensure a clean and accurate cut at a desired length.

In addition, there have now been developed computer controller servomotor driven rotary cutting systems that use servomotors or hydraulic drives programmed to control the speed of rotation of the knife roll. Such systems are designed to vary the speed of the knife roll during a cycle of rotation to shorten or lengthen the cut length of the sheet material as desired. Such electronic or computer controlled servomotor systems, are, however, limited to a narrow range of cut lengths, and the size and weight of the knife rolls and anvil rolls generally requires larger, more powerful servomotors for greater ranges of speed during a cycle of rotation. In addition, such systems are extremely expensive over and above the expense of the knife rolls themselves, in many cases more than doubling the cost of the rotary cutting systems.

Accordingly, it can be seen that a need exists for a variable length rotary cutting system that can be quickly and easily adjusted to enable variations in the cut length provided by the rotary cutter without requiring expensive servomotors or controls, and which can achieve a clean, accurate cut of desired length of sheet material being run in a moving web at high speeds, without stopping.

SUMMARY OF THE INVENTION

Briefly describe, the present invention comprises a variable length rotary cutting system for cutting variable lengths of sheet materials such as non-wovens, papers, foils, films and woven materials. The rotary cutter includes an anvil roll or cylinder that generally is formed from a hardened steel or similar material. A motor is connected to the anvil roll for driving the anvil roll so as to match the speed of the sheet material being fed through the rotary cutter. The rotary cutter includes a knife roll or cylinder formed from a hardened steel, the circumference of which typically is selected based upon a desired cut length. The knife roll includes at least one knife blade mounted on its circumference. As the knife roll and anvil roll are rotated, the knife blade engages the sheet material against the anvil roll for cutting the sheet material.

A drive system for driving the knife roll at varying speeds from the rotation of the anvil roll is provided adjacent one side of the anvil and knife rolls. The drive system generally includes a drive or anvil roll gear mounted on the anvil roll so as to be rotated with the rotation of the anvil roll. The drive gear generally is a toothed gear such as a spur gear having a desired pitch diameter. An offset or knife roll drive gear mounted to a pivoting support frame is engaged by the drive roller. The offset gear generally is a toothed gear or sprocket that typically is of the same or larger pitch diameter than that of the drive gear. The pitch diameters of the drive gear and offset gear generally are selected based upon the length of cut of the sheet material that is desired given the circumference of the knife roll. The offset gear is mounted on an offset gear shaft in an off-center mounting with the axis of rotation of the offset gear spaced from the central axis of the offset gear. As a result, as the offset gear is driven by the drive gear, it rotates at varying speeds based upon the distance between the axis of rotation and the tooth of the offset gear engaging the drive gear.

The support frame for the offset gear and offset gear shaft is pivotally mounted on a transfer shaft so as to be rotatable toward and away from engagement with the drive gear. An air cylinder or spring mechanism is connected to the support frame and pivots and maintains the offset gear in engagement with the drive gear, while the offset gear is rotated.

A first set of timing pulleys are mounted on the offset gear shaft and transfer shaft, respectively, connected with a timing belt or chain so that the rotation of the offset gear at varying speeds is translated to the transfer shaft. A second pair of timing pulleys are mounted to the transfer shaft and a journal for the knife roll, respectively, with an elongated timing belt or chain encircling the pulleys. The timing belt translates the rotation of the transfer shaft, and thus the offset gear, to the knife roll to cause the knife roll to correspondingly rotate at varying rates.

To vary the length of cut provided by the knife roll, the operator pivots the support frame for the offset gear to move the offset gear out of engagement with the drive gear. The operator then replaces the drive gear with a drive gear having a different pitch diameter that is selected for cutting a desired cut length of the sheet material based on the circumference of the knife roll and the pitch diameter or number of teeth of the offset gear. For additional variations in the cut lengths, the offset gear also can be replaced with an offset gear having a different pitch diameter.

Various objects, features and advantages of the present invention will become apparent to those skilled in the art upon a review of the following specification, when taken in conjunction with the accompanying drawings.

DETAILED DESCRIPTION OF THE PREFERRED EMBODIMENTS

Figure 1:
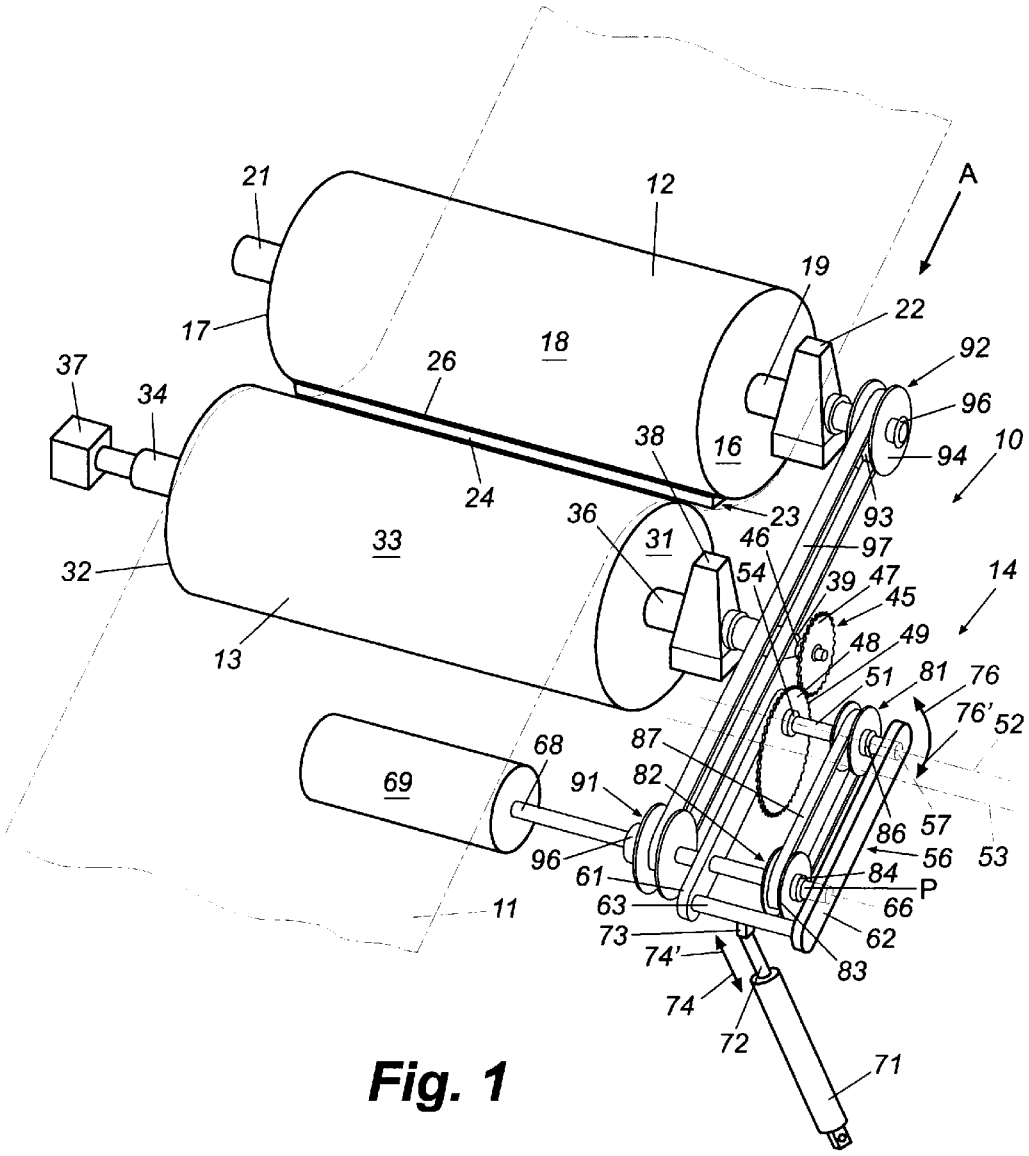
FIG. 1 is a perspective view of the variable length rotary cutting system of the present invention.

Referring now to the drawings in greater detail in which like numerals indicate like parts throughout the several views, FIG. 1 illustrates a variable length rotary cutting system 10 for cutting sheet materials, illustrated in phantom lines 11, such as non-woven materials, paper, films, foils and woven materials passing through the variable length rotary cutting system in the direction of arrow A in a substantially continuous web or sheet from feed roll, (not shown). As the web of sheet material 11 passes through the variable length rotary cutting system, the sheet material is cut into sections or sheets of a desired cut length. The variable length rotary cutting system 10 includes a knife roll 12, anvil roll 13, and a drive system 14 for driving the knife roll with the rotation of the anvil roll 13.

Figure 2:
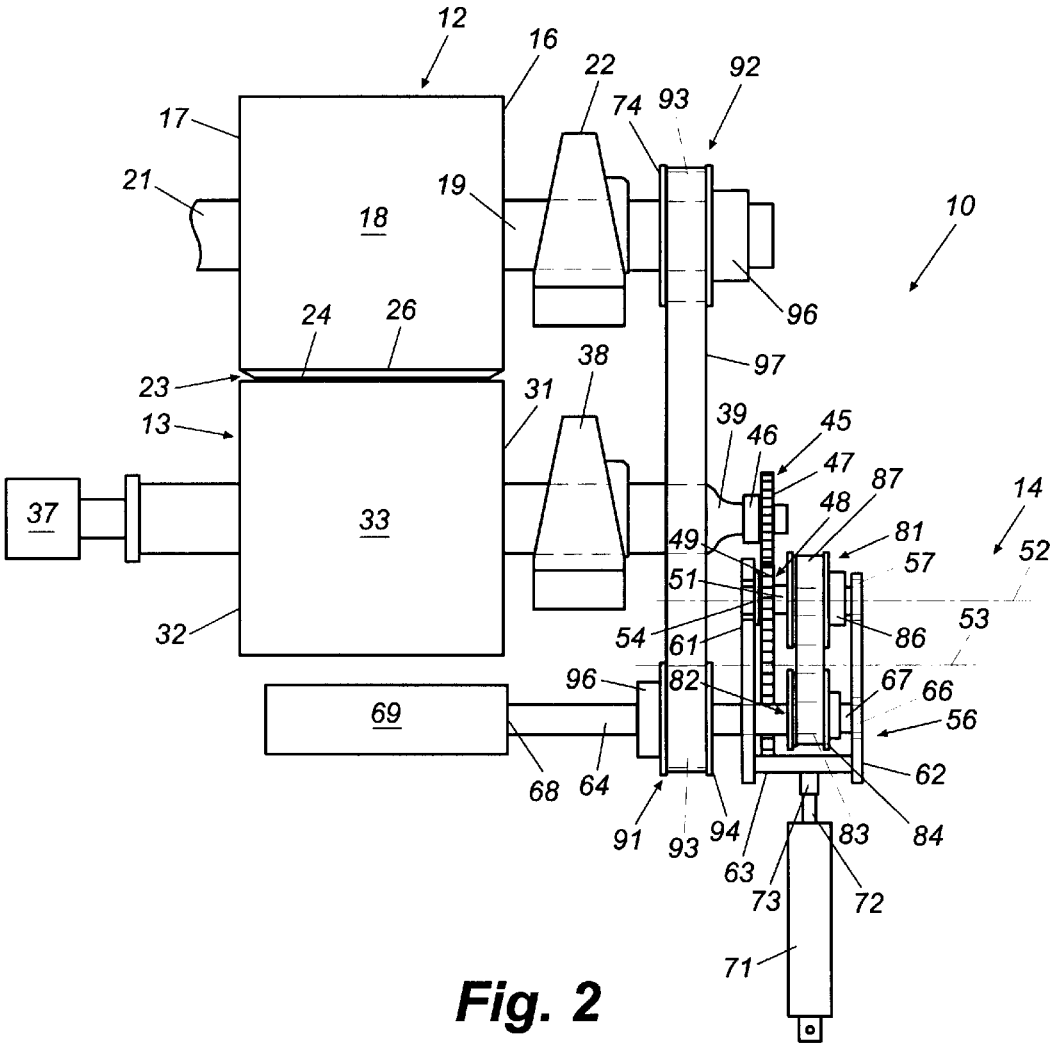
FIG. 2 is an end view of the variable length rotary cutting system of FIG. 1.

As illustrated in FIGS. 1 and 2, the knife roll 12 generally is an elongated cylinder, typically formed from a hardened steel or similar durable material. The knife roll 12 includes first and second ends 16 and 17, a cylindrical side wall 18, and journals or shafts 19 and 21 protruding from the first and second ends 16 and 17 of the knife roll. The circumference of side wall 18 generally is selected for cutting a first, standard cut length of the sheet material as is known in the art. As illustrated in FIG. 2, the journals 19 and 21 of the knife roll extend laterally from the ends of the knife roll, with journal 19 being received through and supported by a flange or cartridge bearing 22 to support the knife roll while enabling the free rotation of the knife roll. Journal 21 is connected to a unidirectional clutch (not shown) or other types of conventional clutch that is engaged for driving the knife roll in one direction and disengages to enable backward rotation of the knife roll manually. The knife roll further is adjustably mounted above the anvil roll for adjusting the position of the knife roll with regard to the anvil roll to adjust the cutting action of the knife role and to adjust for wear to the knife 23 of the knife roll.

The knife 23 (FIGS. 1 and 3) is mounted to the cylindrical side wall 18 of the knife roll at a cut point about the circumference of the knife roll. The knife generally is an elongated cutting blade having a cutting edge 24 that contacts the anvil roll with the sheet material 11 engaged therebetween for cutting the sheet material with a scissors type cutting action. Typically, the knife is formed from a steel or similar material having a hardness less than that of the anvil roll so as not to cut or otherwise damage the anvil roll. The knife further is generally mounted to the side wall of the knife roll with a mount or knife support 26 (FIG. 1) to enable removal of the knife for replacement.

Figure 3:
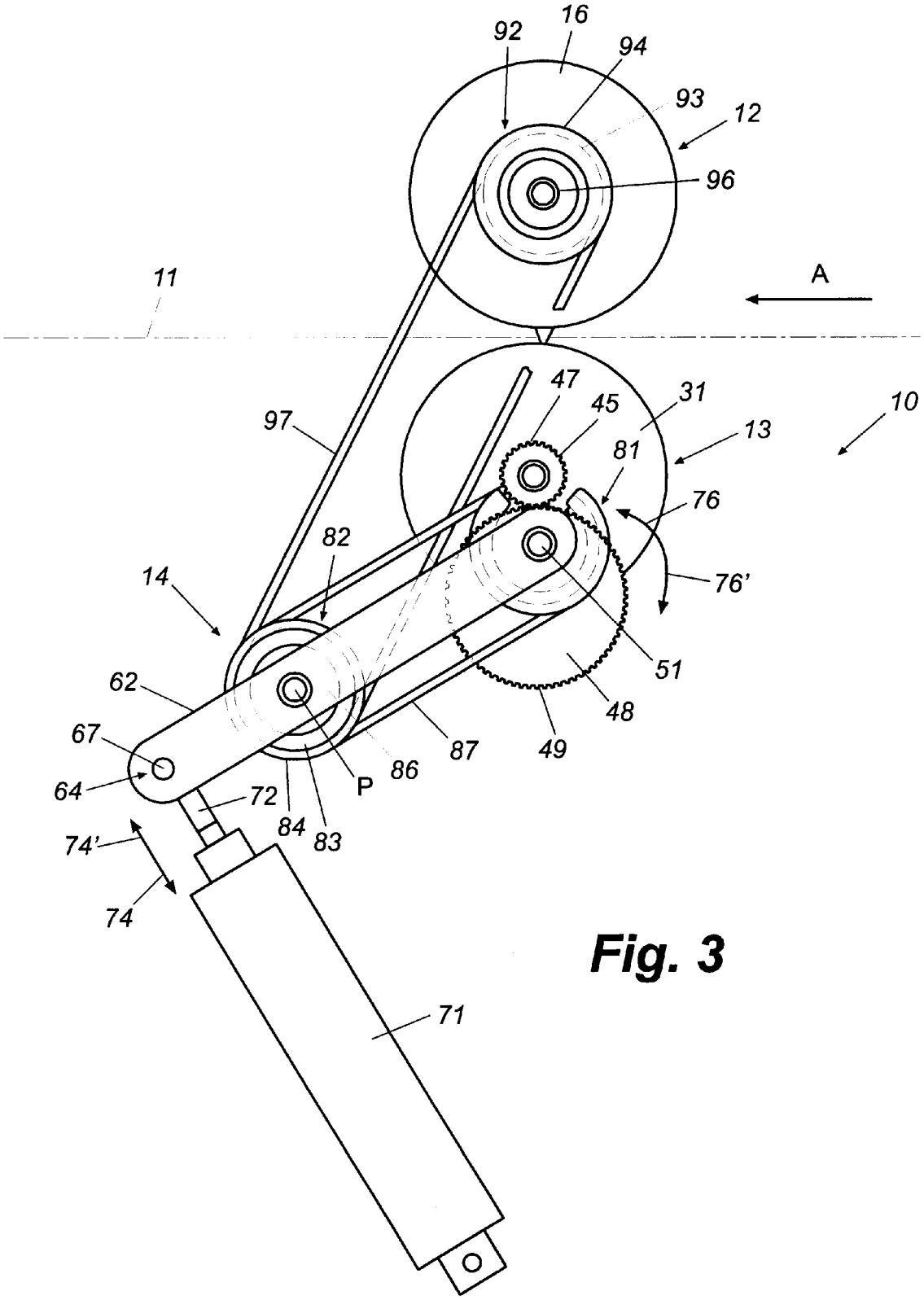
FIG. 3 is a side elevational view illustrating the pivoting frame and air cylinder for supporting and maintaining the offset gear in engagement with the drive gear.

The anvil roll 13 generally is mounted directly beneath the knife roll 12 in a position to be engaged by the knife 22 of the knife roll as illustrated in FIGS. 1–3. The anvil roll generally is formed from a hardened steel material or similar durable, cut resistant material so as to withstand being engaged by the knife roller without being cut, nicked or otherwise damaged by the engagement of the knife blade therewith. The anvil roll normally is an elongated cylinder having, typically of the same length as the knife roll, and includes first and second ends 31 and 32 and a cylindrical side wall 33.

Journals or shafts 34 and 36 project laterally from the ends 31 and 32 of the anvil roll as illustrated in FIGS. 1 and 2. Journal 34 connects to the drive system for the converting or sheeting line along which the rotary cutting system is mounted or can connect to a motor 37 such as a servomotor, stepper motor, variable speed motor or other type of drive for driving the anvil roll as conventionally known. Journal 36 of the anvil roll 13 is received through a flange or cartridge bearing 38 for supporting and enabling rotation of the anvil roll. In addition, journal 36 includes a necked-down or reduced diameter portion 39 (FIG. 1) at its free end.

As illustrated in FIGS. 1 and 2, the drive system 14 of the present invention links the anvil roll to the knife roll so that the knife roll is driven by the rotation of the anvil roll. The drive system generally includes a drive gear or anvil roll gear 45 mounted on the necked-down portion 39 of journal 36 of the anvil roll 13. The drive gear generally is a small spur gear or steel change gear or similar toothed sprocket of standard pitch diameter or size, or tooth set to enable easy changes to a different size gear or tooth set for changing the cut length for the sheet material. The drive gear 45 includes a hub 46 for locking the drives gear in position along the necked down portion 39 of the journal 36. Typically, the drive gear will have between approximately 20 to 120 radially projecting gear teeth 47 formed about its circumference depending upon the desired pitch diameter for cutting the sheet material at a desired cut length. The drive gear is rotated by the rotation of the anvil roll by motor 37 and engages an offset gear 48 as shown in FIGS. 1 and 3.

The offset gear 48 generally is a steel change gear or spur gear that can be of the same size or typically of a larger size than the drive gear, and generally includes between 20 to 500 radially projecting gear teeth 49, preferably between 90 to 120 teeth, formed about its circumference. The offset gear is mounted on an offset gear shaft 51 in an off-center mounting so that its axis of rotation 52 (shown in phantom lines in FIGS. 1 and 2) is radially displaced from the center axis of the offset gear, indicated in phantom lines 53. A locking collar 54 is mounted on the offset gear shaft adjacent the offset gear for locking the offset gear in a position along the offset gear shaft for engagement with the drive gear. As a result of the off-center mounting of the offset gear, as the offset gear rotates, the speed of the rotation of the offset gear shaft 49 is varied. For example, as the pitch radius of the offset gear increases during rotation of the offset gear, the rotation of the knife roll is slowed and as the pitch radius decreases, the speed of rotation of the knife roller is increased. It also will be understood that it is possible to reverse the mounting of the offset gear and the anvil roll gear for further varying the speed of the knife roll as needed to make sheets shorter than the circumference of the knife roll.

The offset gear shaft is rotatably mounted on a support frame 56 with the ends of the offset gear shaft being received in flange bushings 57 (FIGS. 2 and 3). The support frame 56 generally is a substantially U-shaped frame, typically formed from a metal such as steel or a light weight material such as aluminum or similar materials and includes first and second side frame members 61 and 62, and an end frame member 63 that connects the first and second side frame members 61 and 62 at one end thereof. The side frame members are connected at their opposite ends by the offset gear shaft and support the offset gear shaft and offset gear as the offset gear engages and is rotated by the drive gear.

A transfer shaft 64 extends substantially parallel to the offset gear shaft through the first and second side frame members 61 and 62, with the first and second side frame members being pivotably mounted thereto by flange bushings 66. The transfer shaft generally is an elongated shaft, typically formed from steel or similar material having a first end 67 to which side frame member 62 is mounted and a second or distal end 68 that can be mounted to a idler roller 69 as shown in FIGS. 1 and 2. The transfer shaft defines a pivot axis "P" about which the support frame 53 pivots to enable the offset gear to be rotated and maintained in engagement with the drive gear.

An air cylinder 71 is positioned beneath the support frame for controlling the pivoting of the support frame. The air cylinder typically is a hydraulic or pneumatic cylinder and includes a cylinder rod 72 connected to the end frame member 63 by a device or similar attachment mechanism 73. As the cylinder rod 72 is retracted and extended in the direction of arrows 74 and 74', the support frame 53 is pivoted about the transfer shaft 64 about the pivot axis P, in the direction of arrows 76 and 76' to cause the offset gear to be moved toward and away from the drive gear. The air cylinder provides a biasing force sufficient to maintain the teeth of the offset gear in meshing engagement with the teeth of the drive gear as the offset gear is rotated by the drive gear, with the cylinder rod of the air cylinder being extended and retracted as the pitch radius of the offset gear increases and decreases with the rotation of the offset gear to enable the offset gear to move with respect to the drive gear while its teeth remain in engagement therewith. It will also be understood that a spring mechanism such as compression or tension springs or similar biasing devices can be used in place of the air cylinder to provide a biasing force for maintaining the teeth of the offset gear in engagement with the drive gear.

As illustrated in FIGS. 1 and 2, a first set of timing pulleys 81 and 82 are mounted on the offset gear shaft and transfer shaft, respectively. The timing pulleys 81 and 82 generally are aligned parallel to one another and each have a pulley body 83, sides 84, and a locking hub 86 that typically includes a key way and set-screw (not shown) for locking the timing belt pulleys in a desired position along the offset gear shaft and transfer shaft, and include a series of radially protecting teeth (not shown). A timing belt or chain 87 is received about the timing pulleys, in engagement with the teeth thereof. The timing belt 87 generally is a substantially continuous loop belt typically formed from a nylon web with steel reinforcements or a similar drive belt as are known in the art. Timing chains also can be used as desired. The size of the timing belt and timing pulleys and the number of teeth of the timing pulleys are selected based upon horsepower requirements for the cutting system. The timing belt links the timing pulleys 81 and 82 and thus the offset gear shaft to the transfer shaft so that the transfer shaft is rotated at the same varying speeds as the offset gear shaft with the rotation of the offset gear.

A second set of timing pulleys 91 and 92 are mounted on the transfer shaft 64 and the journal 19 of the knife roll 12 as shown in FIGS. 1 and 2. The timing pulleys 91 and 92 are aligned parallel to one another in a matched pair of pulleys, and each typically include a pulley body 93, sides 94, a locking hub 96 for fixing the timing pulleys in place along the knife roll journal and transfer shaft via a set screw (not shown), and a series of radially projecting teeth (not shown). An elongated timing belt 97 is encircled about and connects the timing pulleys 91 and 92 in a driving relationship so that the rotation of the transfer shaft is transferred to the knife roll.

As a result, as the offset gear is rotated by the drive gear, it rotates the offset gear shaft at varying speeds as the pitch radius of the offset gear increases and decreases. This rotation is transmitted to the transfer shaft via the first set of timing pulleys 81 and 82 and timing belt 87 and thereafter to the knife roll via the second set of timing pulleys 91 and 92 and timing belt 97 so that the knife roll accordingly is driven at varying speeds throughout one cycle of rotation. However, as the knife of the knife roll approaches the anvil roll, the rotation of the knife roll is matched with the rotation of the anvil roll and thus the speed of movement of the web or length of sheet material between the rolls so as to achieve a clean, accurate cut of the sheet material.

In operation of the variable length rotary cutting system 10 of the present invention, the operator will select a desired drive or anvil roll gear to produce a desired cut length. Generally, cut length is based on the following formula:

$$\text{Cut length} = K \times (OGT \div DGT)$$

where

K is the knife roll circumference;

OGT is the number of offset gear teeth; and

DGT is the number of drive gear teeth

For example, for a knife roll having a six inch diameter, with a 120 tooth offset gear, a 30 tooth drive gear provides a cut length of 75.36 inches. Similarly, for the same 6 inch diameter knife roll and 120 tooth offset gear, if the drive gear is changed to a 58 tooth gear, the cut length for the sheet length material will be 33.98 inches. A table of cut lengths provided by various size drive gears for a six inch diameter knife roll with 120 and 115 tooth offset gears is attached as Appendix 1. It is also possible to make further adjustments to the cut length by varying the size of the offset gear.

Once the operator has selected the drive gear to produce the desired appropriate cut length for the size knife roll and offset gear being used in the variable length rotary cutting system, and, if required, after having selected a desired size offset gear, the operator mounts the drive gear on the neck down portion 39 of the journal 36 of the anvil roll, setting it in a position such that its teeth 46 to be engaged by the teeth 48 of the offset gear 47. The operator then rotates the knife roll 12 until the gear tooth of the offset gear that matches the pitch diameter of the drive gear is in a position to engage a matching tooth of the drive gear. Thereafter, air cylinder 71 is actuated, causing it to retract its cylinder 72 in the direction of arrow 74 so that the support frame is pivoted about the transfer shaft 64 in the direction of arrow 76. As a result, the offset gear is pivoted upwardly and into engagement with the drive gear with the teeth of the drive gear and offset gear in meshing engagement. The operator then disengages and rotates the knife roll backward until the knife is rotated into its cut position above the anvil roll. The unidirectional clutch or other conventional clutch for the knife roll is then reengaged for operation of the variable length rotary cutting system.

As the sheet material is fed through the variable length rotary cutting system 10, the speed of rotation of the knife roll will vary during its cycle of rotation depending upon the ratio of the pitch diameter of the offset gear to the pitch diameter of the drive gear. For example, if the drive gear has 30 teeth and the offset gear is a 90 tooth gear, the offset gear is rotated one time for every three times that the drive gear rotates. Correspondingly, the speed of the knife roll with respect to the anvil roll will vary as the offset gear rotates one revolution. The off-center mounting of the offset gear enables such variations in the speed of rotation of the knife gear during its rotation and while still enabling the speed of rotation of the knife roll to match to the speed of rotation of the anvil roll at the cut point to ensure a clean, accurate cut of the sheet material at a desired cut length.

To change the cut length for the sheet material, the system is stopped and the offset gear disengaged from the drive gear by reversing the air cylinder 71 to cause its cylinder rod to be extended in the direction of arrow 74' to pivot the support frame, and thus the offset gear, away from the drive gear in the direction of arrow 76'. The operator then selects a new drive gear to produce the appropriate cut length given the knife roll circumference and the existing offset gear. If necessary to achieve a precise cut length, it is also possible for the operator to change the offset gear. The current drive gear is replaced with the new drive gear, and the knife roll is rotated so that the gear tooth on the offset gear that most closely matches the pitch diameter of the drive gear is rotated into a position to engage the drive gear. Thereafter, the air cylinder 71 is actuated to pivot the offset gear into engagement with the drive gear, and the unidirectional clutch of the knife roll is disengaged. The knife roll is then rotated backward so that the knife is moved to its cut position and the unidirectional clutch is reengaged. Thereafter, the machine is ready for operation for cutting a different length of sheet material. The present system enables a cut length of as low as one fifth of up to approximately five times the circumference of the knife roll.

The present invention thus enables quick, easy, and substantially inexpensive changes in the cut length of sheet material so that a wide variation in the cut lengths of sheet material can be provided for a single cutting line, without requiring additional size knife rolls the and change-out of the knife rolls to achieve different cut lengths, and without requiring expensive motor controls. The off-center mounting of the offset gear further insures that the knife roll can be run at varying speeds about a single rotation, but its speed of rotation matched with the speed of rotation of the anvil roll at the cut point. As a result, a clean, accurate cut of the sheet material is achieved with greater repeatability of the cut lengths without requiring multiple knife rolls.

It further will be understood by those skilled in the art that while the present invention has been described above with reference to preferred embodiments, various modifications, changes and additions can be made thereto without departing from the spirit and scope of the present invention as set forth in the following claims.

APPENDIX 1

Cut length table for 115 & 120 tooth off-center gears

| Large Gear | Small Gear | Cut Length | Difference | Large Gear | Small Gear | Cut Length | Difference |
|---|---|---|---|---|---|---|---|
| 120 | 30 | 75.36 | | 120 | 58 | 38.98 | 0.41 |
| 120 | 31 | 72.93 | 2.43 | 115 | 56 | 38.69 | 0.29 |
| 115 | 30 | 72.22 | 0.71 | 120 | 59 | 38.32 | 0.37 |
| 120 | 32 | 70.65 | 1.57 | 115 | 57 | 38.01 | 0.31 |
| 115 | 31 | 69.89 | 0.76 | 120 | 60 | 37.68 | 0.33 |
| 120 | 33 | 66.51 | 1.38 | 115 | 58 | 37.36 | 0.32 |
| 115 | 32 | 67.71 | 0.80 | 120 | 61 | 37.06 | 0.29 |
| 120 | 34 | 66.49 | 1.21 | 115 | 59 | 36.72 | 0.34 |
| 115 | 33 | 65.65 | 0.84 | 120 | 62 | 36.46 | 0.26 |
| 120 | 35 | 64.59 | 1.06 | 115 | 60 | 36.11 | 0.35 |
| 115 | 34 | 63.72 | 0.67 | 120 | 63 | 35.89 | 0.22 |
| 120 | 36 | 62.60 | 0.92 | 115 | 61 | 35.52 | 0.37 |
| 115 | 35 | 61.90 | 0.90 | 120 | 64 | 35.33 | 0.19 |
| 120 | 37 | 61.10 | 0.80 | 115 | 62 | 34.95 | 0.38 |
| 115 | 36 | 60.18 | 0.92 | 120 | 65 | 34.78 | 0.16 |
| 120 | 38 | 59.49 | 0.69 | 115 | 63 | 34.39 | 0.39 |
| 115 | 37 | 58.56 | 0.94 | 120 | 68 | 34.25 | 0.14 |
| 120 | 39 | 57.97 | 0.59 | 115 | 64 | 33.85 | 0.40 |
| 115 | 38 | 57.02 | 0.95 | 120 | 67 | 33.74 | 0.11 |
| 120 | 40 | 56.52 | 0.50 | 115 | 65 | 33.33 | 0.41 |
| 115 | 39 | 55.55 | 0.97 | 120 | 68 | 33.25 | 0.09 |
| 120 | 41 | 55.14 | 0.41 | 115 | 66 | 32.83 | 0.42 |
| 115 | 40 | 54.17 | 0.98 | 120 | 69 | 32.77 | 0.06 |
| 120 | 42 | 53.83 | 0.34 | 115 | 67 | 32.34 | 0.43 |
| 115 | 41 | 52.84 | 0.98 | 120 | 70 | 32.30 | 0.04 |
| 120 | 43 | 52.58 | 0.27 | 115 | 68 | 31.86 | 0.44 |
| 115 | 42 | 51.59 | 0.99 | 120 | 71 | 31.84 | 0.02 |
| 120 | 44 | 51.38 | 0.20 | 120 | 72 | 31.40 | 0.44 |
| 115 | 43 | 50.39 | 1.00 | 115 | 69 | 31.40 | 0.00 |
| 120 | 45 | 50.24 | 0.15 | 120 | 73 | 30.97 | 0.43 |
| 115 | 44 | 49.24 | 1.00 | 115 | 70 | 30.95 | 0.02 |
| 120 | 46 | 49.15 | 0.09 | 120 | 74 | 30.55 | 0.40 |
| 115 | 45 | 48.15 | 1.00 | 115 | 71 | 30.52 | 0.04 |
| 120 | 47 | 48.10 | 0.04 | 120 | 75 | 30.14 | 0.37 |
| 120 | 48 | 47.10 | 1.00 | 115 | 72 | 30.09 | 0.05 |
| 115 | 46 | 47.10 | 0.00 | 120 | 78 | 29.75 | 0.34 |
| 120 | 49 | 46.14 | 0.96 | 115 | 73 | 29.68 | 0.07 |
| 115 | 47 | 46.10 | 0.04 | 120 | 77 | 29.36 | 0.32 |
| 120 | 50 | 45.22 | 0.88 | 115 | 74 | 29.28 | 0.08 |

APPENDIX 1-continued

Cut length table for 115 & 120 tooth off-center gears

| Large Gear | Small Gear | Cut Length | Difference | Large Gear | Small Gear | Cut Length | Difference |
|---|---|---|---|---|---|---|---|
| 115 | 40 | 45.14 | 0.00 | 120 | 78 | 28.90 | 0.29 |
| 120 | 51 | 44.33 | 0.81 | 115 | 75 | 28.89 | 0.10 |
| 115 | 49 | 44.22 | 0.11 | 120 | 79 | 28.62 | 0.27 |
| 120 | 52 | 43.48 | 0.74 | 115 | 76 | 28.51 | 0.11 |
| 115 | 50 | 43.33 | 0.14 | 120 | 80 | 28.26 | 0.25 |
| 120 | 53 | 42.66 | 0.68 | 115 | 77 | 28.14 | 0.12 |
| 115 | 51 | 42.48 | 0.17 | 120 | 81 | 27.91 | 0.23 |
| 120 | 54 | 41.67 | 0.62 | 115 | 78 | 27.78 | 0.13 |
| 115 | 52 | 41.67 | 0.20 | 120 | 82 | 27.57 | 0.21 |
| 120 | 55 | 41.11 | 0.56 | 115 | 79 | 27.43 | 0.15 |
| 115 | 53 | 40.88 | 0.23 | 120 | 83 | 27.24 | 0.19 |
| 120 | 56 | 40.37 | 0.51 | 115 | 80 | 27.08 | 0.16 |
| 115 | 54 | 40.12 | 0.25 | 115 | 61 | 26.75 | 0.33 |
| 120 | 57 | 39.66 | 0.46 | 115 | 82 | 26.42 | 0.33 |
| 115 | 55 | 39.39 | 0.27 | 115 | 83 | 26.10 | 0.32 |

What is claimed is:

1. A method of cutting varying lengths of a sheet material using a rotary cutting system having a knife roll of a desired size and an anvil roll, without requiring a change of the knife roll, comprising:

mounting a drive gear of a desired size on the anvil roll;

driving the drive gear with the rotation of the anvil roll;

mounting an offset gear of a desired size on a gear shaft in an off-center mounting with the offset gear having an axis of rotation displaced radially from a central axis of the offset gear so that the offset gear rotates at varying rates;

engaging the drive gear with the offset gear and driving the offset gear with the drive gear;

driving the knife roll with the rotation of the offset gear to cause the knife roll to rotate at varying rates with respect to the rotation of the anvil roll;

substantially matching the rate of rotation of the anvil roll with the rate of rotation of the knife roll at a cut-point;

urging the offset gear into engagement with the drive gear to enable the offset gear to move with respect to the drive gear as the offset gear is rotated, while maintaining the offset gear in engagement with the drive gear as the offset gear is rotated; and cutting the sheet material into desired lengths.

2. The method of claim 1 and further including the steps of removing the drive gear and mounting a second drive gear having a different size to change the length of cut of the sheet material.

3. The method of claim 1 and wherein urging the offset gear into engagement comprises actuating a cylinder to pivot the offset gear toward the drive gear.

4. The method of claim 1 and further comprising selecting the sizes of the drive gear and offset gear to provide a desired cut length depending on the size of the knife roll.

5. An apparatus for cutting lengths of a sheet material, comprising:

a knife roll having a knife;

an anvil roll mounted adjacent said knife roll in a position to be engaged by said knife for cutting the sheet material;

a drive system for driving said knife roll at varying speeds, said drive system including a drive gear having a desired pitch diameter and mounted to said anvil roll, an offset gear of a desired size mounted in an off-center mounting and engaging said drive gear so as to rotate at varying speeds with the rotation of said drive gear, a transfer shaft driven by the rotation of said offset gear for driving said knife roll, and a support frame pivotally mounted to said transfer shaft and supporting said offset gear;

a biasing device communicating with said support frame for biasing said offset gear into meshing engagement with said drive gear to enable said offset gear to move with respect to said drive gear while remaining in meshing engagement therewith;

whereby said knife roll is rotated at varying speeds by the rotation of said offset gear for cutting the sheet material into desired lengths.

6. The apparatus of claim 5 and wherein the pitch diameter of said drive gear is selected for cutting a desired length of sheet material based upon the size of said offset gear and diameter of said knife roll.

7. The apparatus of claim 5 and further including a motor for driving said anvil roll.

8. An apparatus for cutting lengths of a sheet material, comprising:

a knife roll having a knife;

an anvil roll mounted adjacent said knife roll in a position to be engaged by said knife for cutting the sheet material; and a drive system for driving said knife roll at varying speeds, said drive system including a drive gear having a desired pitch diameter and mounted to said anvil roll, an offset gear of a desired size mounted in an off-center mounting and engaging said drive gear so as to rotate at varying speeds with the rotation of said drive gear, and a transfer shaft driven by the rotation of said offset gear for driving said knife roll; and a first series of timing pulleys mounted on said off-center shaft and said transfer shaft, and a timing belt received about said timing pulleys, connecting said timing pulleys so that as said offset gear is rotated, said transfer shaft is rotated;

whereby said knife roll is rotated at varying speeds by the rotation of said offset gear for cutting the sheet material into various desired lengths.

9. The apparatus of claim 8 and further including a second series of timing pulleys mounted to said transfer shaft and to said knife roll, and a drive belt extended about said timing pulleys for transmitting the rotation of said transfer shaft to said knife roll such that said knife roll is driven at varying speeds with the rotation of said offset gear.

10. The apparatus of claim 5 and wherein said biasing device comprises a cylinder for urging and maintaining said offset gear into engagement with said drive gear.

11. The apparatus of claim 5 and wherein said off-center gear includes between approximately 20 to 500 gear teeth.

* * * * *